US006906301B2

(12) United States Patent
Yamaguchi

(10) Patent No.: US 6,906,301 B2
(45) Date of Patent: Jun. 14, 2005

(54) MOUNTING STRUCTURES FOR A HIGH-FREQUENCY HEATING APPARATUS

(75) Inventor: Takahide Yamaguchi, Kashiba (JP)

(73) Assignee: Matsushita Electric Industrial Company, Ltd., Osaka (JP)

( * ) Notice: Subject to any disclaimer, the term of this patent is extended or adjusted under 35 U.S.C. 154(b) by 31 days.

(21) Appl. No.: 10/354,701

(22) Filed: Jan. 30, 2003

(65) Prior Publication Data

US 2003/0150855 A1 Aug. 14, 2003

(30) Foreign Application Priority Data

Jan. 31, 2002 (JP) ..... P. 2002-023034

(51) Int. Cl.[7] ..... H05B 6/80
(52) U.S. Cl. ..... 219/761; 219/756
(58) Field of Search ..... 219/761, 756, 219/746, 748; 315/39.51

(56) References Cited

U.S. PATENT DOCUMENTS 4,701,586 A * 10/1987 Hagberg ..... 219/746
5,391,964 A * 2/1995 Lim ..... 315/39.71

FOREIGN PATENT DOCUMENTS

| | | | |
|---|---|---|---|
| JP | 9-145062 | * | 6/1997 |
| KR | 2001-0057061 | * | 7/2001 |
| KR | 2002-0007545 | * | 1/2002 |

* cited by examiner

*Primary Examiner*—Philip H. Leung
(74) *Attorney, Agent, or Firm*—Pearne & Gordon LLP

(57) ABSTRACT

A high-frequency heating apparatus includes a magnetron (1), a magnetron holding plate (2), a waveguide (3), a heating chamber (4), and screws (5), and the magnetron (1) is attached to the magnetron holding plate (2) with two screws. Hereby, attachment of the magnetron is facilitated, speed-up of the manufacturing process of the high-frequency heating apparatus can be realized, and production efficiency can be improved. Further, in the breakdown repair requiring exchange of the magnetron, working time can be also reduced, so that service to customers can be also improved.

21 Claims, 4 Drawing Sheets

MOUNTING STRUCTURES FOR A HIGH-FREQUENCY HEATING APPARATUS

BACKGROUND OF THE INVENTION

1. Field of the Invention

The invention relates to a high-frequency heating apparatus capable of rationalizing magnetron-attaching work in a manufacturing process of a high-frequency heating apparatus so that a high-speed manufacturing line of the high-frequency heating apparatus is made possible, and capable of readily performing magnetron-exchanging work at an end user's home, so that a repairing time is reduced and improvement of service to customers can be performed.

2. Description of the Related Art

In order to prevent leakage of high-frequency waves from a joint between a magnetron and a magnetron holding plate or a joint between a magnetron and a waveguide, in a high-frequency heating apparatus, the magnetron is attached onto the magnetron holding plate with three or four screws so that the magnetron can stand against vibration and shock produced at the goods conveying time.

A general high-frequency heating apparatus is shown in FIG. 6.

In FIG. 6, reference numeral 1 indicates a magnetron, 2 indicates a magnetron holding plate, 3 indicates a waveguide, 4 indicates a heating chamber wall, and 5 indicates a screw. The waveguide 3 and the magnetron holding plate 2, and the waveguide 3 and the heating chamber wall 4 are joined by welding or caulking. An antenna la of the magnetron 1 is inserted into a hole 3*a* of the waveguide 3 horizontally and thereafter four or three screws 5 are tighten to attach the magnetron 1.

However, under the above apparatus, in a manufacturing process of the high-frequency heating apparatus, it is necessary for a worker attaching the magnetron 1 to continuously perform the steps of inserting the antenna 1*a* of the magnetron 1 into the hole 3*a* of the waveguide 3 horizontally and attaching the magnetron 1 with four or three screws 5 while holding the magnetron 1 so that the magnetron 1 does not slip from the magnetron holding plate 2. This work must be performed by one worker in order to prevent positional slippage of the magnetron 1 and to prevent the slippage between the magnetron 1 and screw holes of the magnetron holding plate 2 when the screws 5 are tightened, so that its work cannot correspond to rationalization and speed-up of a manufacturing process. Further, the work of inserting the antenna 1*a* of the magnetron 1 into the hole 3*a* of the waveguide 3 horizontally requires concentration power of the worker. Further, if the worker erroneously hits the antenna 1*a* of the magnetron 1 on the surroundings of the hole 3*a* of the waveguide 3 when he inserts it, oscillation frequency of the magnetron 1 varies, so that the magnetron 1 becomes bad.

When the apparatus breaks down, a service man visits a home of a customer who is an end user to repair the apparatus. However, the number of customers who have limited at-home time such as a worker in double harness and a worker apart from his family is recently increasing. Therefore, though the repair at customer's home requires the short repairing time, the exchange or repair of the magnetron cannot be performed in the short time.

SUMMARY OF THE INVENTION

In order to solve the above problems, an object of the invention is to provide a high-frequency heating apparatus which rationalizes an attachment method of a magnetron, performs speed-up of a manufacturing process and reduction of repair and exchange time of the magnetron, and realizes error reduction of the magnetron in the manufacturing process.

According to the first aspect of the invention, a high-frequency heating apparatus of the invention includes a high-frequency generating unit, a heating chamber into which food is stored, a waveguide that guides high-frequency waves generating from the high-frequency generating unit to the heating chamber, and a holding plate for fixing the high-frequency generating unit to the waveguide, and further is so constituted that the high-frequency generating unit is attached to the holding plate with at most two screws. Hereby, attachment of the high-frequency generating unit is facilitated, speed-up of the manufacturing process of the high-frequency heating apparatus can be realized, and production efficiency can be improved. Further, in the breakdown repair, working time can be also reduced, so that service can be improved.

According to the second aspect of the invention, one side of attachment flanges of the high-frequency generating unit according to the first aspect is inserted into holes provided for the holding plate, and the other side thereof is attached to the holding plate with the at most two screws. Hereby, the relative position between the screws becomes close, and operation of work necessary to tighten the screws becomes small. Therefore, the time is reduced and simultaneously physical load on the worker can be reduced. Further, since the attachment flanges of the high-frequency generating unit are inserted to and held by the holding plate, the high-frequency generating unit can be fixed to the holding plate more strongly than a case where the high-frequency generating unit is attached to the holding plate with four screws. Therefore, there can be allowances of strength in relation to vibration and shock produced at the goods conveying time. In result, packing material including foaming polystyrol and corrugated cardboards can be miniaturized or thinned, and saving of resources and cost-reduction can be attempted.

According to the third aspect of the invention, a rotary guide is provided for the holding plate according to the second aspect. When the high-frequency generating unit is turned about the attachment flanges of the high-frequency generating unit inserted into the holding plate along the rotary guide, the high-frequency generating unit can be positioned to the holding plate with a regular locus. Hereby, without fear that the antenna is damaged erroneously, the high-frequency generating unit can be attached, and error reduction of the high-frequency generating unit and stabilization of quality of the high-frequency heating apparatus can be realized. Further, since there is no fear that the antenna is damaged, the speed of the work of positioning the high-frequency generating unit is improved, and the speed-up of the manufacturing process can be realized.

According to the fourth aspect of the invention, claws for holding the high-frequency generating unit are provided in the vicinity of the holes of the holding plate into which the attachment flanges of the high-frequency generating unit are inserted, whereby even if a worker releases his hold of the high-frequency generating unit before tightening the screw during the attachment work of the high-frequency generating unit, the high-frequency generating unit does not fall down but is held. Therefore, the worker can perform the screw tightening work with his both hands, so that it is possible to reduce the time necessary to attach the high-frequency generating unit. Further, since the high-frequency generating unit does not fall down if the screw is not tightened, the attachment work of the high-frequency generating unit may be performed by a worker who positions the high-frequency generating unit to the holding plate and a worker who performs the screw-tightening work. Hereby, since the amount of work per person can be reduced, speed-up of the manufacturing process can be realized.

According to the fifth aspect of the invention, the holding plate according to the second aspect has a drawn portion larger than the area of the attachment flanges of the high-frequency generating unit inserted into the holding plate, and the depth of the drawn portion is smaller than the thickness of the inserted attachment flange of the high-frequency generating unit. Hereby, a joint between the high-frequency generating unit and the holding plate or a joint between the high-frequency generating unit and the waveguide becomes strong, and leakage of high-frequency waves from the joint can be prevented equivalently to or more than the case of the attachment of the related art by only screw tightening.

DETAILED DESCRIPTION OF THE PREFERRED EMBODIMENT

Embodiments of the invention will be described below with reference to drawings.

(Embodiment 1)

Figure 1:
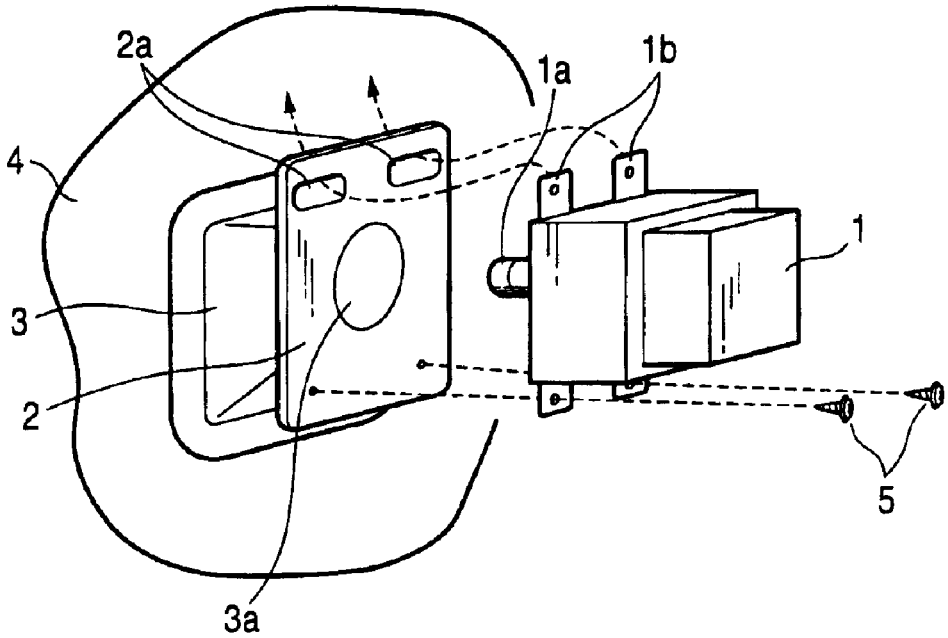
FIG. 1 is an assembly diagram for magnetron attachment in a first embodiment of the invention.

FIG. 1 is an assembly diagram for attaching a high-frequency generating unit of a high-frequency heating apparatus in a first embodiment of the invention.

In FIG. 1, reference numeral 4 indicates a heating chamber wall onto which a waveguide 3 indicates attached by welding or caulking, and further a magnetron holding plate 2 indicates attached to the waveguide 3 similarly by welding or caulking. For the magnetron holding plate 2, holes 2*a* for inserting attachment flanges 1*b* of the magnetron 1 provided as a high-frequency generating unit are provided.

Regarding the thus constituted magnetron holding plate, its operation and working will be described below.

Firstly, the attachment flanges 1*b* of the magnetron 1 are inserted into the holes 2 of the magnetron holding plate 2, and the magnetron 1 is turned up and down about the inserted attachment flanges 1*b* to insert an antenna 1*a* of the magnetron 1 into a hole 3*a* of the waveguide 3. Thereafter, two screws 5 are tightened to the flanges on the opposite side to the inserted attachment flanges 1*b* of the magnetron 1.

As described above, in this embodiment, the number of the screws 5 used for attaching the magnetron 1 is reduced from the conventional three or four screws to two screws, whereby the working time necessary to attach the magnetron 1 is reduced, physical load onto a worker can be reduced by speed-up of a manufacturing process and reduction of the working amount, and service to customers can be improved by reduction of the magnetron exchanging time in the breakdown repair.

Further, in the embodiment, two holes 2*a* are provided for the magnetron holding plate 2. Since the attachment flanges 1*b* of the magnetron 1 are inserted to their holes 2*a*, the magnetron can be fixed to the magnetron holding plate more strongly than a case where the magnetron is attached to the magnetron holding plate with four screws. Therefore, there can be allowances of strength in relation to vibration and shock. In result, packing material including foaming polystyrol and corrugated cardboards can be miniaturized or thinned, and saving of resources and cost-reduction can be attempted.

Figure 2:
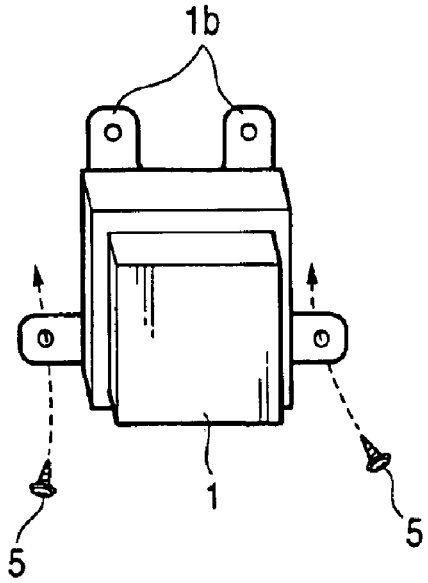
FIG. 2 is a perspective view of the magnetron in the first embodiment of the invention.

Further, positions at which the screws 5 are tightened may be sides of the attachment flanges 1*b* of the magnetron 1 adjoining to each other one by one as shown in FIG. 2, not on the opposite side to the inserted side of the attachment flanges 1*b* of the magnetron 1 as shown in FIG. 1. In this case, the similar effect to that in the foregoing can be obtained.

(Embodiment 2)

Figure 3:
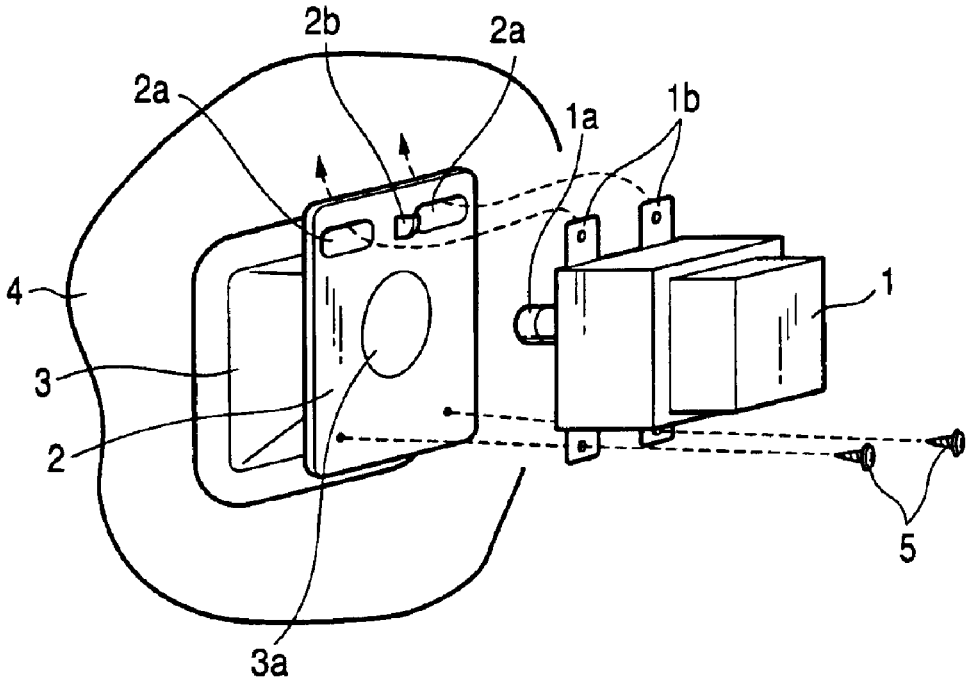
FIG. 3 is a perspective view of a magnetron holding plate in a second embodiment of the invention.

FIG. 3 is a perspective view of a magnetron holding plate 2 in a second embodiment of the invention, and this embodiment is different from the first embodiment in that a rotary guide 2*b* is provided for the magnetron holding plate 2. Since the same reference numerals as those in the first embodiment have the same structure, their explanation are omitted.

Firstly, attachment flanges 1*b* of a magnetron 1 are inserted into holes 2*a* of the magnetron holding plate 2. Thereafter, when the magnetron 1 is pushed against the rotary guide 2*b* and turned along the shape of the rotary guide 2*b*, it is positioned to the magnetron holding plate 2 with a regular locus.

Figure 4:
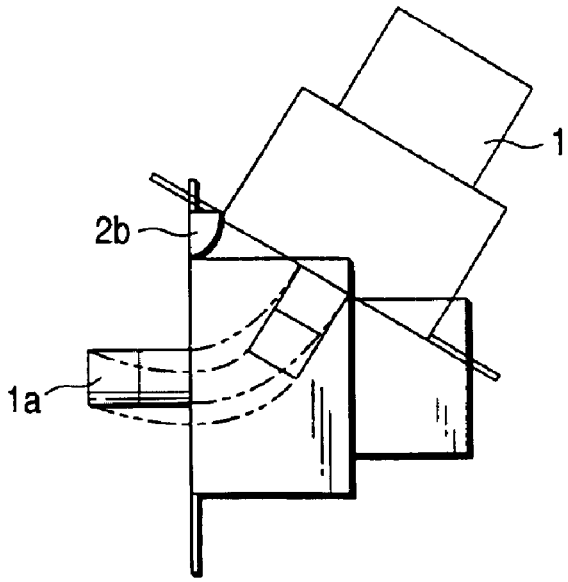
FIG. 4 is a locus diagram of a magnetron attaching operation in the second embodiment of the invention.

As described above, in the embodiment, since the rotary guide 2*b* is provided for the magnetron holding plate 2, the magnetron 1 draws a regular locus as shown in FIG. 4 when it is attached. Therefore, without fear that an antenna la of the magnetron 1 is erroneously hit against the waveguide 3 and damaged, error reduction of the magnetron and stabilization of quality of the high-frequency heating apparatus can be realized. Further, in FIG. 3 showing this embodiment, the number of the rotary guide 2*b* is one. However, even if plural guides are provided, the similar effect can be obtained.

(Embodiment 3)

Figure 5:
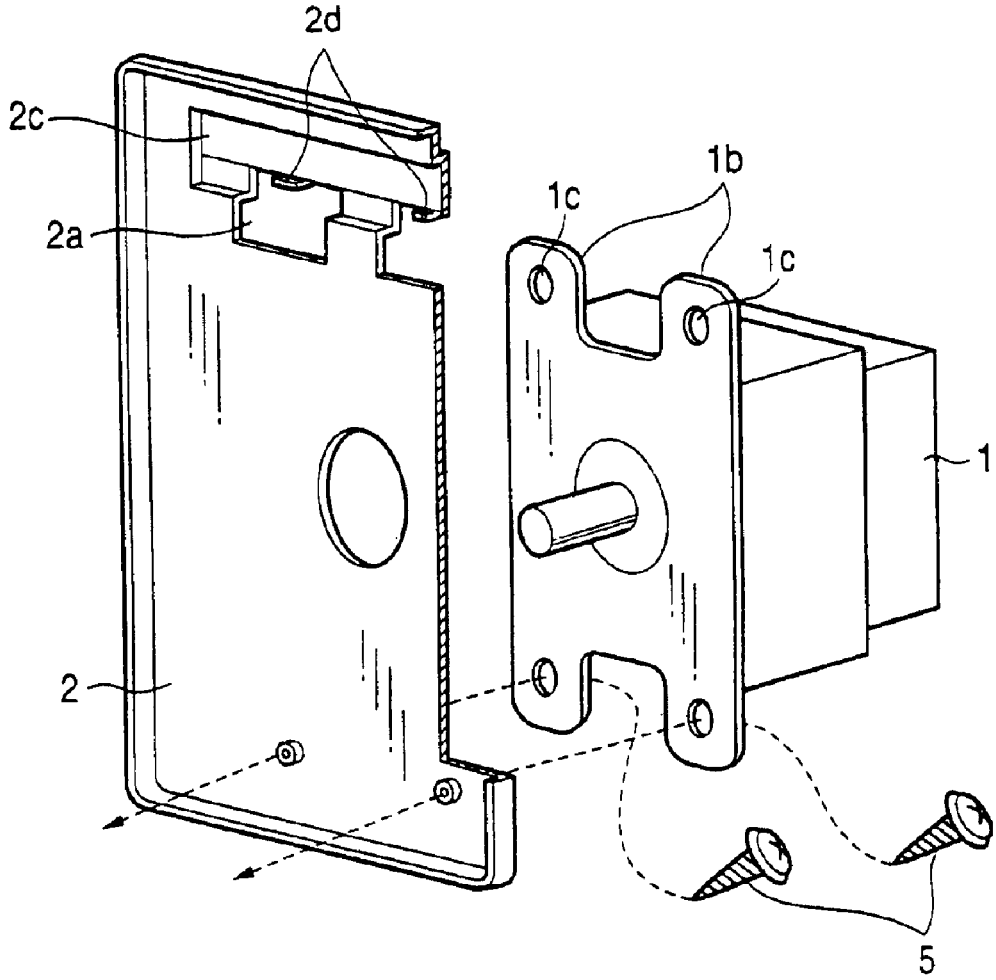
FIG. 5 is a perspective sectional view of a magnetron holding plate in a third embodiment of the invention.
Figure 6:
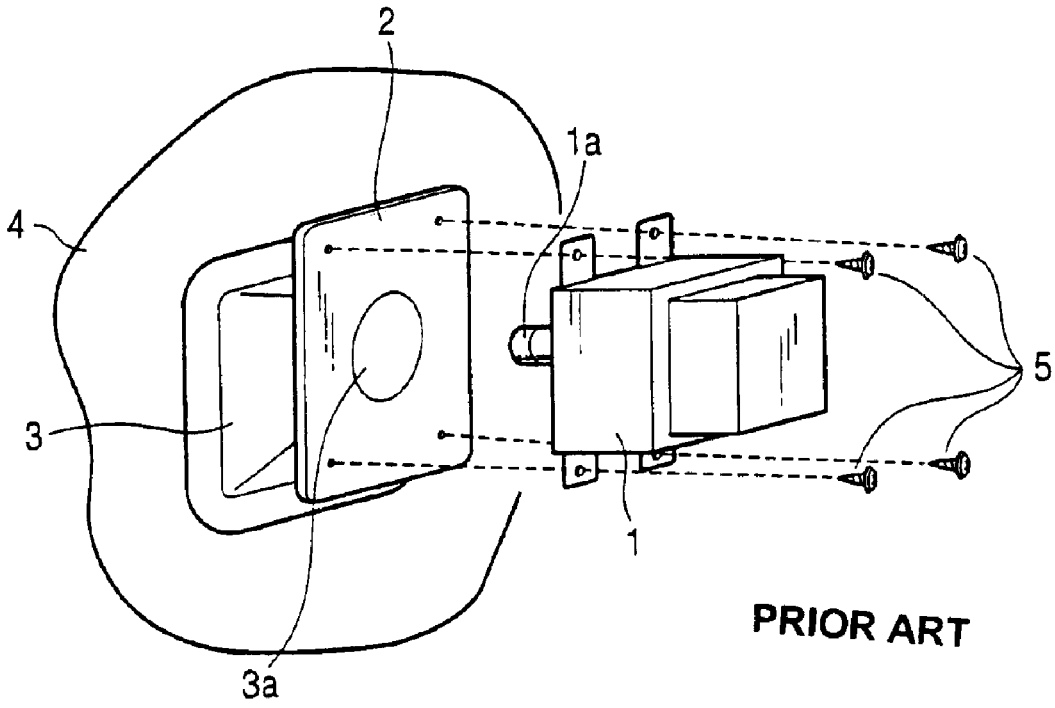
FIG. 6 is an assembly diagram for magnetron attachment in a general high-frequency heating apparatus.

FIG. 5 shows a perspective sectional view of a magnetron holding plate 2 in a third embodiment of the invention.

In FIG. 5, this embodiment is different from the first embodiment in that claws 2*d* holding a magnetron 1 are provided for upper sides of holes 2*a* of the magnetron holding plate 2. Since the same reference numerals as those in the first embodiment have the same structure, their explanation are omitted.

Firstly, attachment flanges 1*b* of the magnetron 1 are inserted into the holes 2*a* of the magnetron holding plate 2. For the attachment flanges 1*b* of the magnetron 1, holes 1*c* such as screw holes used for tightening screws in the conventional constitution are provided. Their holes 1*c* are passed through the claws 2*d* of the magnetron holding plate 2, whereby even if a worker releases his hold of the magnetron 1 before tightening the screws 5 during the magnetron attachment work, the magnetron 1 does not fall down but is held. Therefore, the worker can perform the screw tightening work with his both hands, so that it is possible to reduce the time necessary to attach the magnetron 1. Further, since the magnetron 1 does not fall down even if the crew is not tightened, the magnetron attachment work may be performed by a worker who positions the magnetron 1 to the magnetron holding plate 2 and a worker who performs the screw tightening work. Hereby, since the amount of work per person can be reduced, speed-up of the manufacturing process can be realized.

Further, in this embodiment, there is provided a drawn portion 2*c* larger than the area of the attachment flanges 1*b* of the magnetron 1 inserted into the magnetron holding plate 2, and the depth of the drawn portion 2*c* is smaller than the thickness of the inserted attachment flange 1*b* of the magnetron 1. Hereby, a joint between the magnetron 1 and the magnetron holding plate 2 or a joint between the magnetron 1 and the waveguide 3 becomes strong, and leakage of high-frequency waves from the joint can be prevented equivalently to or more than the case of the conventional magnetron attachment by only screw tightening.

As described above, according to the invention, by rationalizing the attachment method of the magnetron, speed-up of the manufacturing process and reduction of repair and exchange time of the magnetron can be performed, and further error reduction of the magnetron in the manufacturing process can be realized.

What is claimed is:

1. A high-frequency heating apparatus comprising:

a high-frequency generating unit including a first attachment flange, a second attachment flange, and a third attachment flange;

a heating chamber;

at most two screws;

a waveguide which guides high-frequency waves generating from said high-frequency generating unit to said heating chamber; and a holding plate for fixing said high-frequency generating unit to the waveguide, said holding plate including a first side, a second side, and a first hole and a second hole both through said first side to said second side, wherein said high-frequency generating unit is attached to the first side of said holding plate and wherein said first attachment flange engages said holding plate through said first hole, said third attachment flange engages said holding plate through said second hole, and further wherein said second attachment flange is attached to said first side of said holding plate using at least one of said at most two screws.

2. A high-frequency heating apparatus comprising:

a high-frequency generating unit including a first attachment flange and a second attachment flange;

a heating chamber;

at most two screws;

a waveguide which guides high-frequency waves generating from said high-frequency generating unit to said heating chamber; and a holding plate for fixing said high-frequency generating unit to the waveguide, said holding plate including a first side, a second side, and a first hole and a second hole both through said first side to said second side, wherein said high-frequency generating unit is attached to the first side of said holding plate and wherein said first attachment flange engages said holding plate through said first hole, and further wherein said second attachment flange is attached to said first side of said holding plate using at least one of said at most two screws, wherein said holding plate comprises a rotary guide which allows said high-frequency generating unit to turn the high-frequency generating unit with a predetermined locus.

3. The high-frequency heating apparatus according to claim 2, wherein said high-frequency generating unit is turned about a point on said first attachment flange.

4. A high-frequency heating apparatus comprising:

a high-frequency generating unit including a first attachment flange and a second attachment flange;

a heating chamber;

at most two screws;

a waveguide which guides high-frequency waves generating from said high-frequency generating unit to said heating chamber; and a holding plate for fixing said high-frequency generating unit to the waveguide, said holding plate including a first side, a second side, and a first hole and a second hole both through said first side to said second side, wherein said holding plate comprises a claw provided in the vicinity of the hole into which the first attachment flange is inserted to hold the high-frequency generating unit.

5. A high-frequency heating apparatus comprising:

a high-frequency generating unit including a first attachment flange and a second attachment flange;

a heating chamber;

at most two screws;

a waveguide which guides high-frequency waves generating from said high-frequency generating unit to said heating chamber; and a holding plate for fixing said high-frequency generating unit to the waveguide, said holding plate including a first side, a second side, and a first hole and a second hole both through said first side to said second side, wherein the holding plate comprises a drawn portion larger than the area of the first attachment flange, and the depth of the drawn portion is smaller than the thickness of the first attachment flange.

6. A high-frequency heating apparatus comprising:

a high-frequency generating unit including a first attachment flange and a second attachment flange;

a heating chamber;

at most two screws;

a waveguide which guides high-frequency waves generating from said high-frequency generating unit to said heating chamber; and a holding plate for fixing said high-frequency generating unit to the waveguide, said holding plate including a first side, a second side, and a first hole and a second hole both through said first side to said second side, wherein said holding plate further includes a second hole, and wherein said high-frequency generating unit further includes a second attachment flange, a third attachment flange, and a fourth attachment flange, and wherein said third attachment flange engages said second hole such that said third attachment flange is substantially adjacent to said second side of said holding plate, and wherein said second and fourth attachment flanges are each attached to the holding plate with one of the at most two screws.

7. The high-frequency heating apparatus according to claim 6, wherein said holding plate comprises a rotary guide provided between the holes and projecting from the holding plate to allow said high-frequency generating unit to turn the high-frequency generating unit with a predetermined locus.

8. The high-frequency heating apparatus according to claim 6, wherein a flange hole is provided in each of said first and third attachment flanges, and wherein said holding plate comprises claws provided in the vicinity of the first and second holes of the holding plate respectively, and the claws are respectively inserted into the first and second holes.

9. The high-frequency heating apparatus according to claim 8, wherein the claws are provided on a surface of the holding plate at a side of the holes, the surface is opposite to a surface where the high-frequency generating unit is provided, and claws project from the surface.

10. The high-frequency heating apparatus according to claim 6, wherein the holding plate comprises a drawn portion larger than the area of the first and third attachment flanges, and the depth of the drawn portion is smaller than the thickness of the first and third attachment flanges.

11. The high-frequency heating apparatus according to claim 10, wherein the drawn portion is provided to include an area where a part of one or both of the holes is provided.

12. A high-frequency heating apparatus comprising:

a high-frequency generating unit including a first attachment flange having a first flange hole, a second attachment flange, and a third attachment flange having a third flange hole;

a heating chamber;

a waveguide which guides high-frequency waves generating from said high-frequency generating unit to said heating chamber; and a holding plate for fixing said high-frequency generating unit to said waveguide, said holding plate having a first hole, a second hole, a first claw associated with said first hole, and a second claw associated with said second hole, wherein said high-frequency generating unit is attached to said holding plate with said first attachment flange engaging said first hole and said first claw engaging said first flange hole and said third attachment flange engaging said second hole and said second claw engaging said third flange hole, and further wherein said second attachment flange is attached to said holding plate using a connecting component.

13. The high-frequency heating apparatus of claim 12, wherein said connecting component is a screw.

14. The high-frequency heating apparatus according to claim 12, wherein said holding plate further includes a rotary guide which allows said high-frequency generating unit to turn the high-frequency generating unit with a predetermined locus.

15. The high-frequency heating apparatus according to claim 14, wherein said holding plate further includes a drawn portion larger than the area of the first and third attachment flanges, and wherein the depth of the drawn portion is smaller than the thickness of the first and third attachment flanges, and further wherein said claws are integrated with said drawn portion.

16. A high-frequency heating apparatus comprising:

a high-frequency generating unit having an attachment flange;

a heating chamber;

a waveguide which guides high-frequency waves generating from said high-frequency generating unit to said heating chamber; and a holding plate for fixing said high-frequency generating unit to the waveguide, said holding plate having a hole and a rotary guide in the vicinity of the hole which allows said high-frequency generating unit to turn the high-frequency generating unit about a predetermined locus, wherein said high-frequency generating unit is attached to the holding plate with at most two screws and with said attachment flange engaging through said first hole.

17. A high-frequency heating apparatus comprising:

a high-frequency generating unit having an attachment flange;

a heating chamber;

a waveguide which guides high-frequency waves generating from said high-frequency generating unit to said heating chamber; and a holding plate for fixing said high-frequency generating unit to the waveguide, said holding plate having a hole and a rotary guide in the vicinity of the hole which allows said high-frequency generating unit to turn the high-frequency generating unit about a predetermined locus, wherein said high-frequency generating unit is attached to the holding plate with at most two screws and with said attachment flange engaging said first hole, and wherein said holding plate includes a claw provided in the vicinity of the hole with which a flange hole in said attachment flange is engaged to hold the high-frequency generating unit.

18. A high-frequency heating apparatus comprising:

a high-frequency generating unit having an attachment flange;

a heating chamber;

a waveguide which guides high-frequency waves generating from said high-frequency generating unit to said heating chamber; and a holding plate for fixing said high-frequency generating unit to the waveguide, said holding plate having a hole and a rotary guide in the vicinity of the hole which allows said high-frequency generating unit to turn the high-frequency generating unit about a predetermined locus, wherein said high-frequency generating unit is attached to the holding plate with at most two screws and with said attachment flange engaging said first hole, and wherein the holding plate includes a drawn portion larger than the area of the attachment flange, and the depth of the drawn portion is smaller than the thickness of the attachment flange.

19. A high-frequency heating apparatus comprising:

a high-frequency generating unit having first, second, third and fourth attachment flanges;

a heating chamber;

a waveguide which guides high-frequency waves generating from said high-frequency generating unit to said heating chamber;

a holding plate for fixing said high-frequency generating unit to the waveguide, said holding plate including a first side and a second side, and also including a first hole through said holding plate from said first side to said second side, a second hole through said holding plate from said first side to said second side; and exactly two screws for attaching said waveguide to said first side of said holding plate, wherein said first flange engages said holding plate through said first hole to said second side, and said third flange engages said holding plate through said second hole to said second side, and wherein each of said second and fourth attachment flanges are attached to said first side by using one of said exactly two screws, respectively.

20. The high-frequency heating apparatus according to claim 19, wherein said holding plate includes a first claw provided in the vicinity of the first hole and a second claw provided the vicinity of the second hole, and wherein said first and third attachment flanges each have a flange hole for engaging said first and second claws, respectively.

21. A high-frequency heating apparatus comprising:

a high-frequency generating unit including:

first attachment flange having a first flange hole;

a second attachment flange having a second flange hole;

a third attachment flange having a third flange hole, and a fourth attachment flange having a fourth flange hole;

a heating chamber;

a waveguide which guides high-frequency waves generating from said high-frequency generating unit to said heating chamber;

a holding plate for fixing said high-frequency generating unit to the waveguide, said holding plate including a first hole through said holding plate and a second hole through said holding plate, and also including a drawn portion forming a first claw in the vicinity of said first hole and a second claw in the vicinity of said second hole; and exactly two screws for attaching said waveguide to said holding plate, wherein said first flange engages said first hole with said first claw engaging said first flange hole, and said third flange engages said second hole with said second claw engaging said third flange hole, and wherein each of said second and fourth attachment flanges are attached to said first side by using one of said exactly two screws through said second and fourth flange holes, respectively.

* * * * *